US012127654B2

(12) United States Patent
Kuchler

(10) Patent No.: US 12,127,654 B2
(45) Date of Patent: Oct. 29, 2024

(54) FOLDABLE WHEELED SUITCASE AND STEERING ROLLER

(71) Applicant: marwin GmbH, Munich (DE)

(72) Inventor: Marcus Kuchler, Munich (DE)

(73) Assignee: marwin GMBH, Munich (DE)

( * ) Notice: Subject to any disclaimer, the term of this patent is extended or adjusted under 35 U.S.C. 154(b) by 32 days.

(21) Appl. No.: 17/603,043

(22) PCT Filed: Jun. 2, 2020

(86) PCT No.: PCT/IB2020/055196
§ 371 (c)(1),
(2) Date: Oct. 12, 2021

(87) PCT Pub. No.: WO2020/208621
PCT Pub. Date: Oct. 15, 2020

(65) Prior Publication Data

US 2022/0192332 A1 Jun. 23, 2022

(30) Foreign Application Priority Data

Apr. 12, 2019 (DE) ..... 20 2019 001 691.0
Apr. 12, 2019 (DE) ..... 20 2019 001 692.9

(51) Int. Cl.
*A45C 7/00* (2006.01)
*A45C 5/03* (2006.01)
*A45C 5/14* (2006.01)

(52) U.S. Cl.
CPC ..... *A45C 7/0036* (2013.01); *A45C 5/03* (2013.01); *A45C 5/14* (2013.01)

(58) Field of Classification Search
CPC ..... A45C 7/0036; A45C 5/03; A45C 5/14
See application file for complete search history.

(56) References Cited

U.S. PATENT DOCUMENTS 1,683,029 A * 9/1928 Fanger ..... B62B 5/0083 280/47.35
2,425,035 A * 8/1947 Garnett ..... A45C 7/0077 383/18
2,686,581 A * 8/1954 Smith ..... A45C 5/02 190/126
3,814,220 A 6/1974 Brody
5,493,755 A 2/1996 Kindstrand et al.
(Continued)

FOREIGN PATENT DOCUMENTS

CN 102835804 A 12/2012
CN 205250613 U 5/2016
(Continued)

OTHER PUBLICATIONS

International Search Report and Written Opinion issued in connection with the corresponding International Application No. PCT/IB2020/055196 on Sep. 3, 2020.
(Continued)

*Primary Examiner* — Tri M Mai
(74) *Attorney, Agent, or Firm* — The H.T. Than Law Group

(57) ABSTRACT

Foldable travel case, comprising: a top and a bottom side (3), a hinge side (2) and at least one side surface (1), wherein the top and bottom sides (3), the hinge sides (2) and the at least one side surface (1) are connected to each other via connecting strips (4).

8 Claims, 16 Drawing Sheets

(56) References Cited

U.S. PATENT DOCUMENTS

| | | | | |
|---|---|---|---|---|
| 6,035,982 | A * | 3/2000 | Wei-Chih | A45C 3/001 190/126 |
| 7,175,010 | B1 | 2/2007 | Miner | |
| 8,668,064 | B2 * | 3/2014 | Santy | A45C 3/001 190/127 |
| 9,204,696 | B2 * | 12/2015 | Tseng | A45C 5/02 |
| 2006/0169691 | A1 | 8/2006 | Rothschild et al. | |
| 2010/0218532 | A1 | 9/2010 | Beliczynski | |
| 2013/0192943 | A1 * | 8/2013 | Cross | B29C 65/18 428/167 |
| 2019/0263251 | A1 | 8/2019 | Rallings | |
| 2019/0307216 | A1 | 10/2019 | Tan | |
| 2021/0298437 | A1 | 9/2021 | Fraiman et al. | |

FOREIGN PATENT DOCUMENTS

| | | | | |
|---|---|---|---|---|
| CN | 106108319 | A | 11/2016 | |
| CN | 206150683 | U | 5/2017 | |
| CN | 107432538 | A | 12/2017 | |
| DE | 202004017509 | U1 | 2/2005 | |
| GB | 520473 | A | 4/1940 | |
| JP | S48049010 | U | 6/1973 | |
| JP | S50041931 | U | 4/1975 | |
| JP | S61100220 | U | 6/1986 | |
| WO | WO-2015164974 | A1 * | 11/2015 | A45C 5/146 |
| WO | 2017064739 | A1 | 4/2017 | |

OTHER PUBLICATIONS

Machine translation of CN 102835804 to Zhang.
Machine translation of CN 206150683 to Quanzhou Fantexi Intelligent Tech Co Ltd.
Chinese First Examination Report issued in connection with the corresponding Chinese Patent Application No. 202080038333.7 on Dec. 15, 2022.
Japanese First Examination Report issued in connection with the corresponding Japanese Patent Application No. 2021-560706.
Machine translation to JPS48-049010U.
Machine translation to JPS50-041931U.
Second Chinese Office Action issued in connection with the corresponding Chinese Patent Application No. 202080038333.7 on Jul. 13, 2023.
Machine translation of CN 106108319 A to Wuxi Jiade Machinery Co Ltd.
Machine translation of CN 107432538 A to Foshan Tianyicheng Environmental Protection Tech Co Ltd.
Machine translation of CN 205250613 U to Jingmu (Zhuhai) Co Ltd.
Machine translation of DE 2004017509 U1 to Kuchler Marcus.

* cited by examiner

FOLDABLE WHEELED SUITCASE AND STEERING ROLLER

TECHNICAL FIELD

The present invention relates to a foldable wheeled case and steering wheels, in particular for such a foldable wheeled case.

BACKGROUND

Travel cases and their case shells are usually made of metal, leather, fabric material or plastic and are composed of 2 rigid or slightly flexible case halves, which are held together by a case frame with hinge and lock or by a zipper, thus creating a stable container.

This creates a volume that can be defined in liters. In most cases, this volume value together with the external dimensions represent the essential technical characteristics of the case. On average, a travel case has a volume of 80 liters.

People around the world go on vacation for 2 weeks on average 1 time per year, during which clothing, shoes and toiletries as well as everyday accessories are packed into a larger travel case. This means that a case with a volume of 80 liters is stored on 50 weeks a year.

A family of 4 with 4 cases therefore stores about 320 liters of volume for 50 weeks a year, in the basement, attic or garage. In the fewest cases the travel cases, due to wheels, handles and attachments can be stacked one inside the other. Even if this is possible, the volume of the largest cases remains for storage.

Whether a single person or a family, a similar problem arises at the destination of a trip. Whether in a hotel room or on a sailboat. The volume of travel cases has no place. They get in the way or occupy the space actually needed in the closet.

Manufacturers produce cases all over the world. After production, they store and ship these, empty cases with gigantic volume, at high prices around the globe and store them again at your dealers, who pay a high price for the storage of the voluminous cases due to good location.

Travel cases and travel bags are usually equipped with wheels to facilitate their transport. The majority of travel cases and travel bags have either a pair of fixed wheels with a common virtual axis of rotation on an edge facing the floor, or usually 4 360-degree swivel single or double wheels, which are mounted in each of the 4 corners on the bottom sides.

The large 360 degree swivel range of these wheels takes up more volume per wheel arrangement than the wheels themselves. Either the outer dimensions of a case increase, or the wheels are partially integrated into the volume of the case, resulting in a reduction of the packing volume. To reduce this unused volume and the weight of the travel case, the wheels are kept as small as possible.

This has the effect of poor handling and high driving noise, especially on uneven ground.

Wheels that swivel 360 degrees protrude from the actual outer dimensions of the case, depending on its position, due to gravity, and increase the volume of the case, especially when loading a case into a trunk or luggage compartment.

Based on this prior art, the present invention has the object of disclosing a foldable wheeled case and a wheel particularly suitable for use in such a foldable wheeled case.

This object and other objects which will still be mentioned when reading the following description, or which may be recognized by the person skilled in the art, are solved by the object of the independent claims. The dependent claims further form the central idea of the present invention in a particularly advantageous manner.

DETAILED DESCRIPTION OF THE INVENTION

A foldable travel case according to the invention, comprises: a top side, a bottom side, a hinge side and at least one side surface, wherein the top side, the bottom side, the hinge sides and the at least one side surface are connected to each other by connecting strips.

Advantageously, the connecting strips are provided of a soft elastic material of plastic, rubber, silicone, textile, fabric or a combination thereof.

Advantageously, the at least one side surface is a large side surface of a case half.

Preferably, at least two opposite sides of both case halves are connecting strips of soft elastic, material of plastic, rubber, silicone, textile, fabric or a combination thereof, arranged at 45 degrees to the short edges, starting from the corners.

Preferably, the at least two opposing sides are the top and bottom.

Preferably, one or more wheels are attached to and extend beyond the large side surface.

Further, the present invention relates to a steering wheel mounted in pairs on each of the two largest sides on a case or bag, wherein the wheel mounted per axle in the axle mount, has a vertical steering axis centered on the width of the wheel.

Preferably, the steering axis is located in front of the axle in the direction of travel, so that there is thus an overtravel of the wheel.

Preferably, there is a spring element between the mounting and the axle mount, which causes the axle mount and thus the axle to return to a defined position.

Preferably, the steering axle is inclined about the axis in such a way that the wheel causes an automatic return to a defined position when loaded vertically by the axle mount.

Preferably, the mounting is part of, or fixed to, the case or bag side surface.

Preferably, the wheel, the axle mount and the mounting are made of plastic or metal.

DESCRIPTION OF THE EMBODIMENTS

Figure 1:
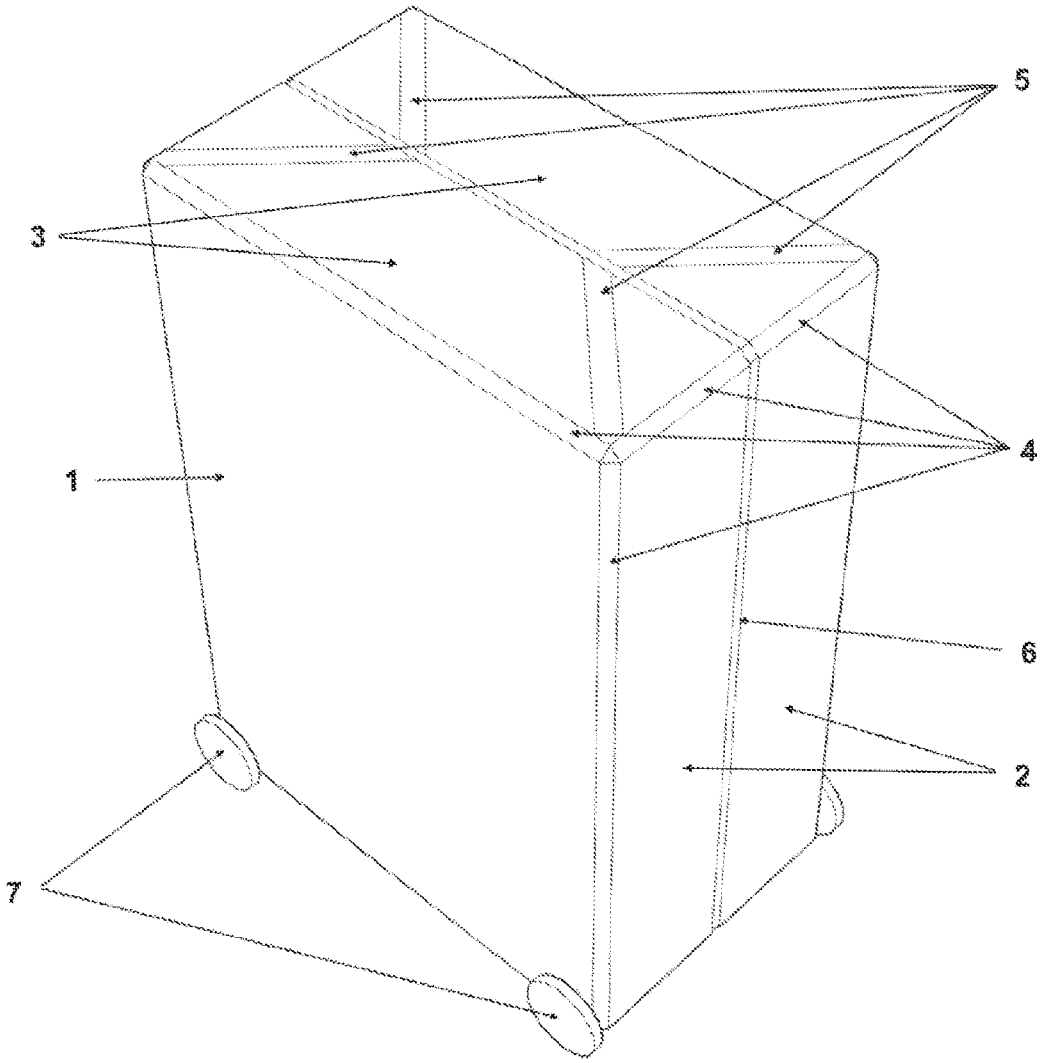
FIG. 1*a* schematic illustration of a preferred embodiment of a foldable wheeled case.
Figure 2:
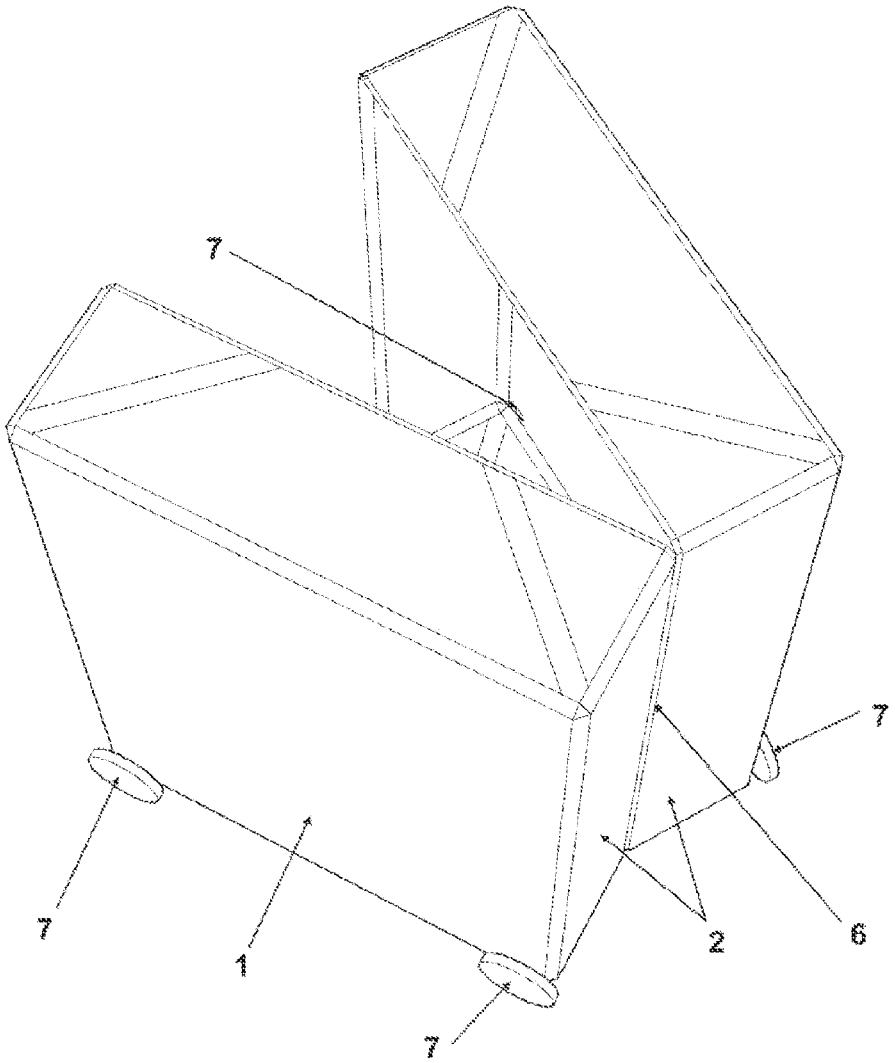
FIG. 2 is a schematic illustration of the foldable wheeled case shown in FIG. 1.
Figure 3:
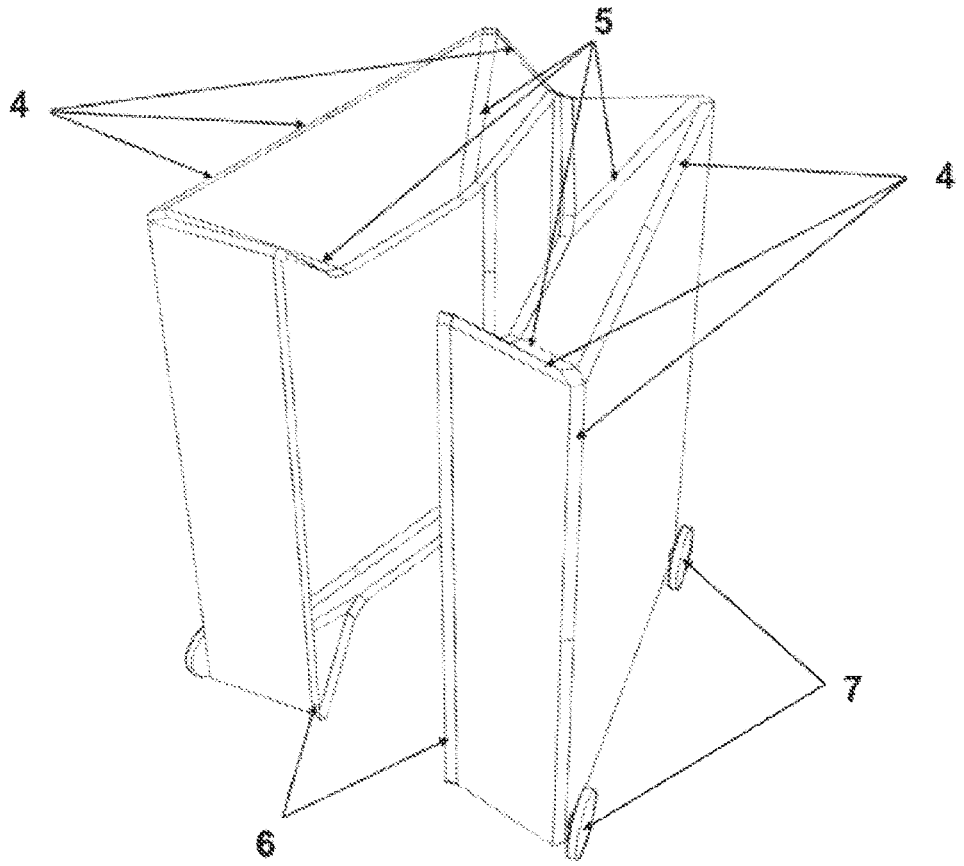
FIG. 3 is a schematic illustration of the foldable wheeled case embodiment shown in FIG. 1.
Figure 4:
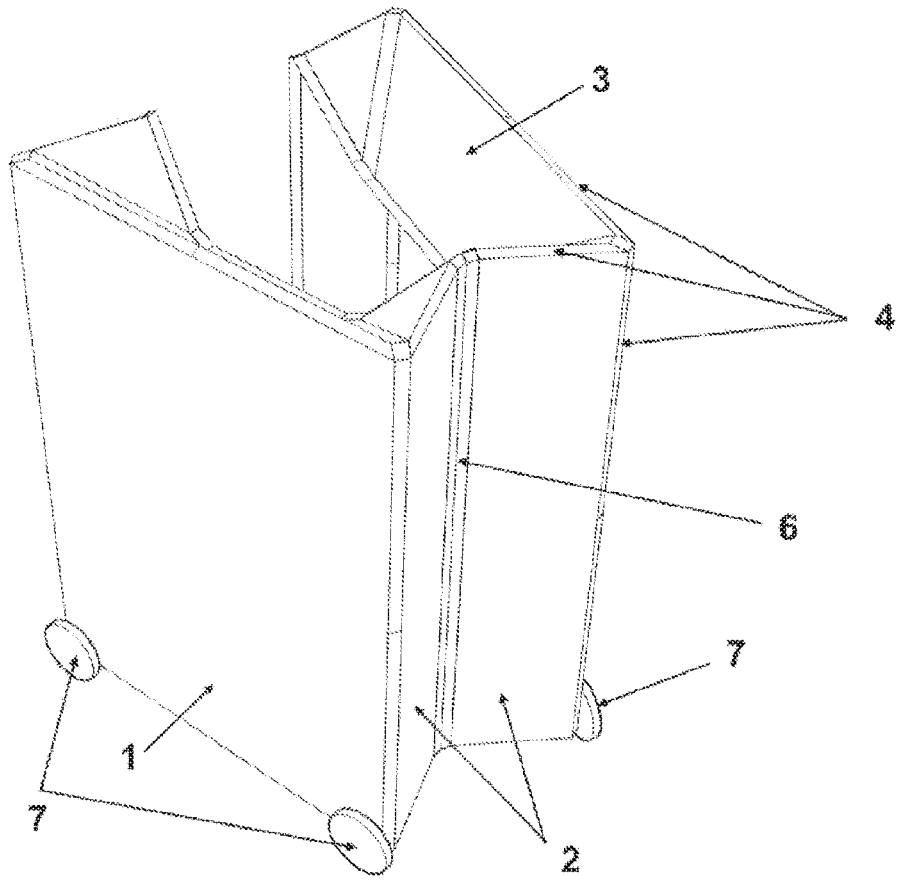
FIG. 4 is a schematic illustration of the foldable wheeled case shown in FIG. 1.
Figure 5:
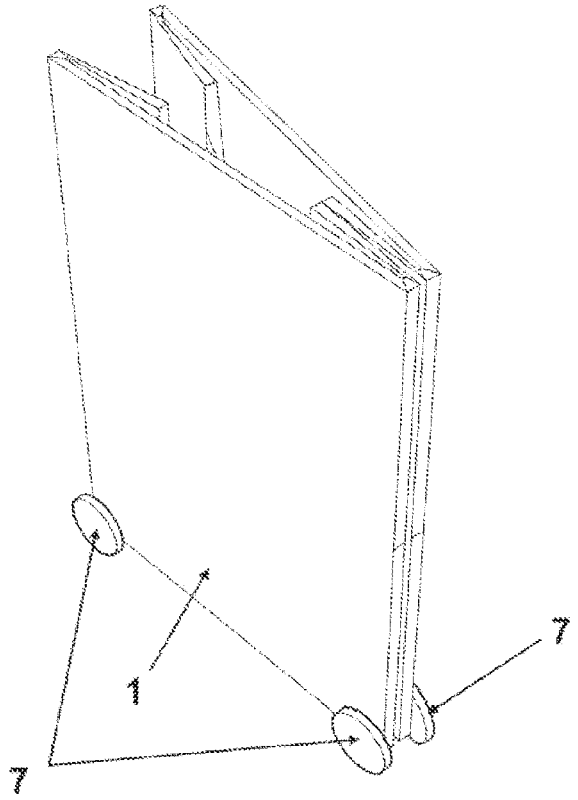
FIG. 5 is a schematic illustration of the foldable wheeled case shown in FIG. 1.
Figure 6:
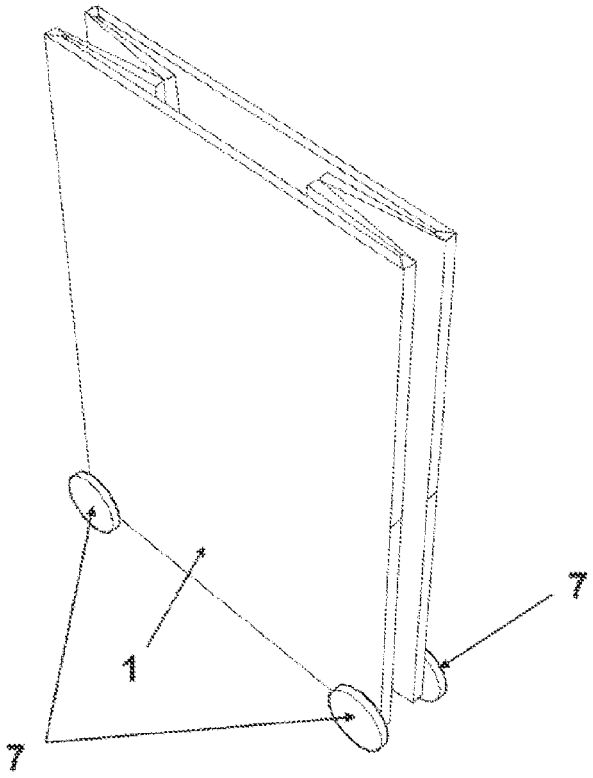
FIG. 6 is a schematic illustration of the foldable wheeled case shown in FIG. 1.
Figure 7:
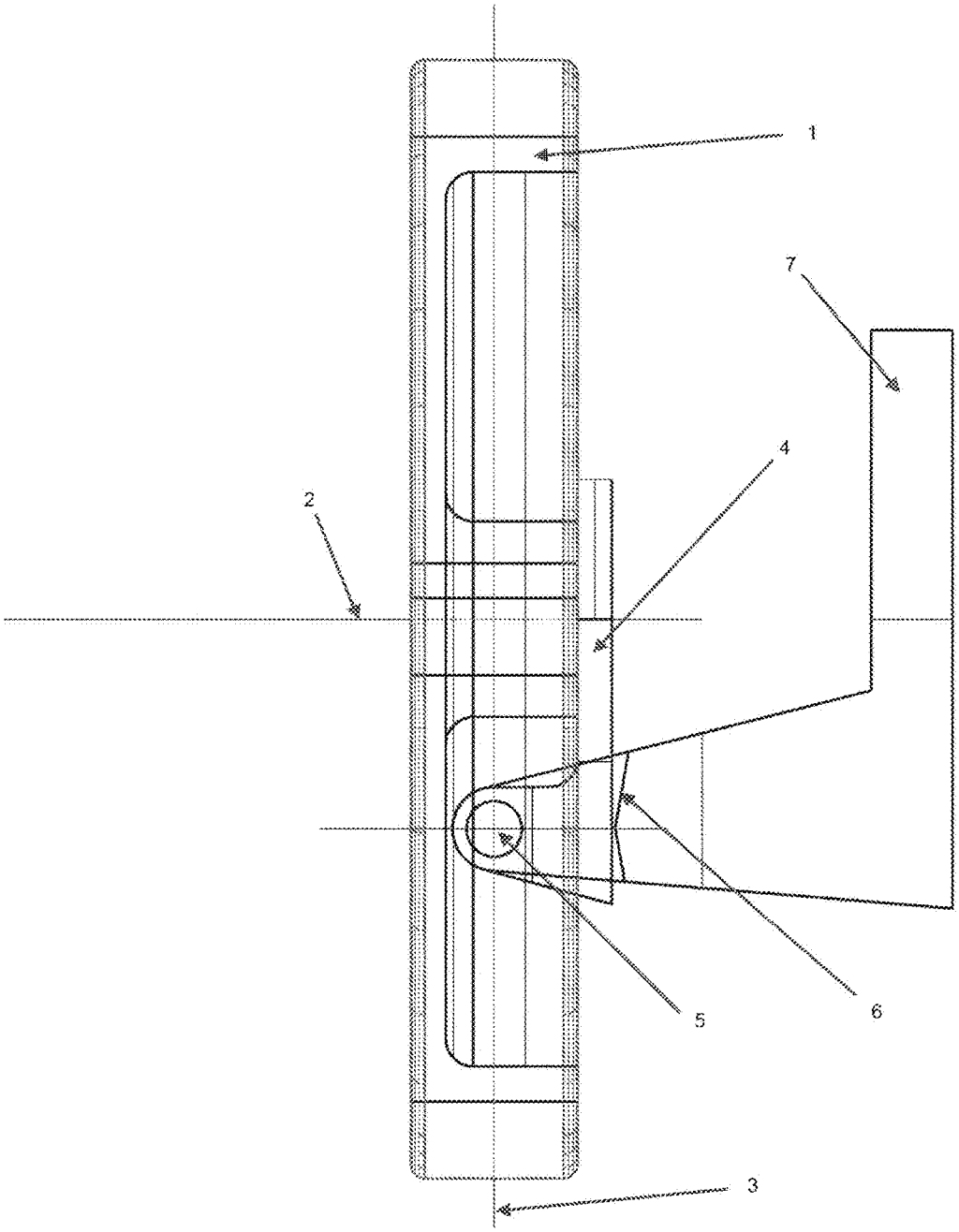
FIG. 7 is a schematic illustration of a preferred embodiment of a steering wheel.
Figure 8:
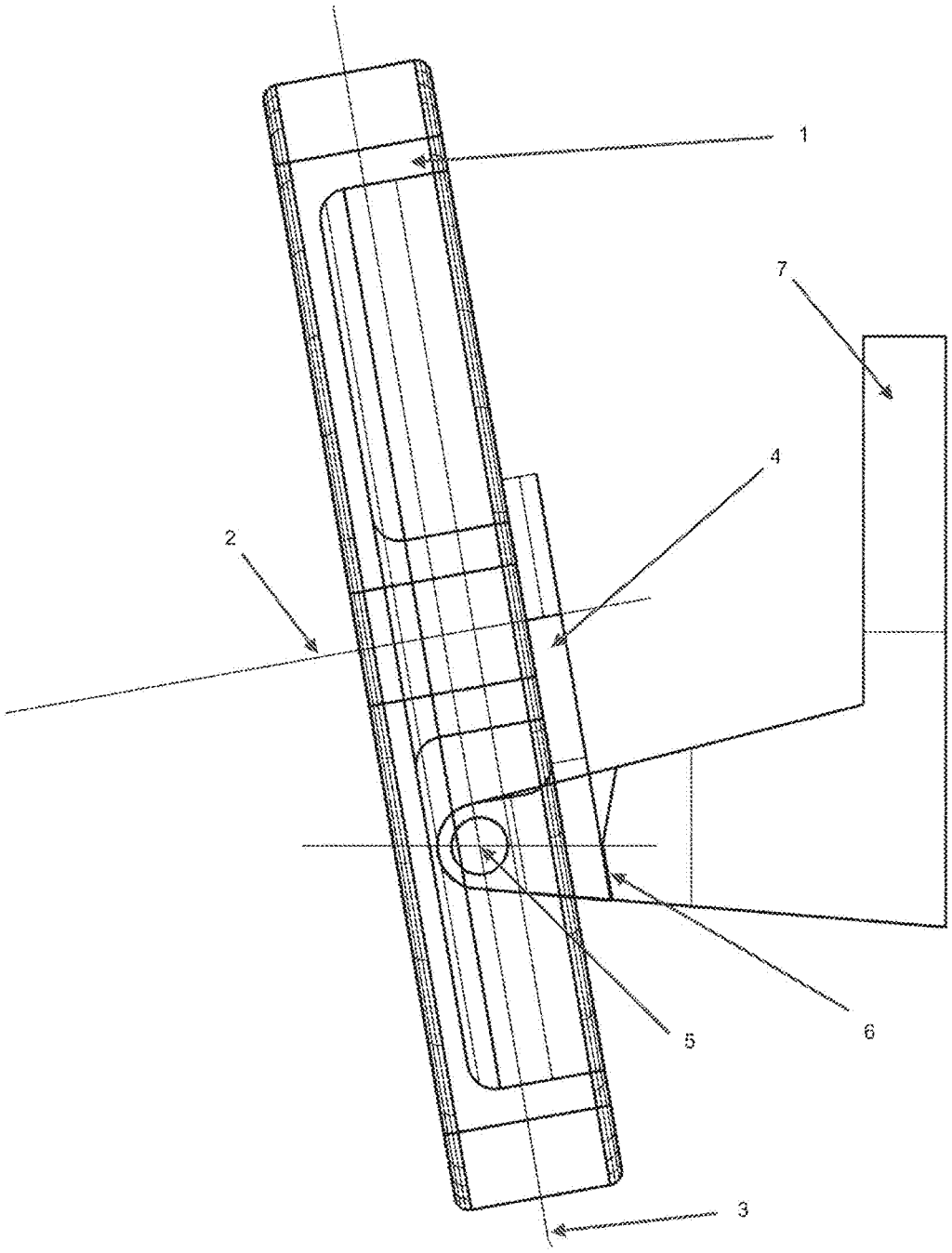
FIG. 8 is a schematic illustration of the steering wheel embodiment shown in FIG. 7.
Figure 9:
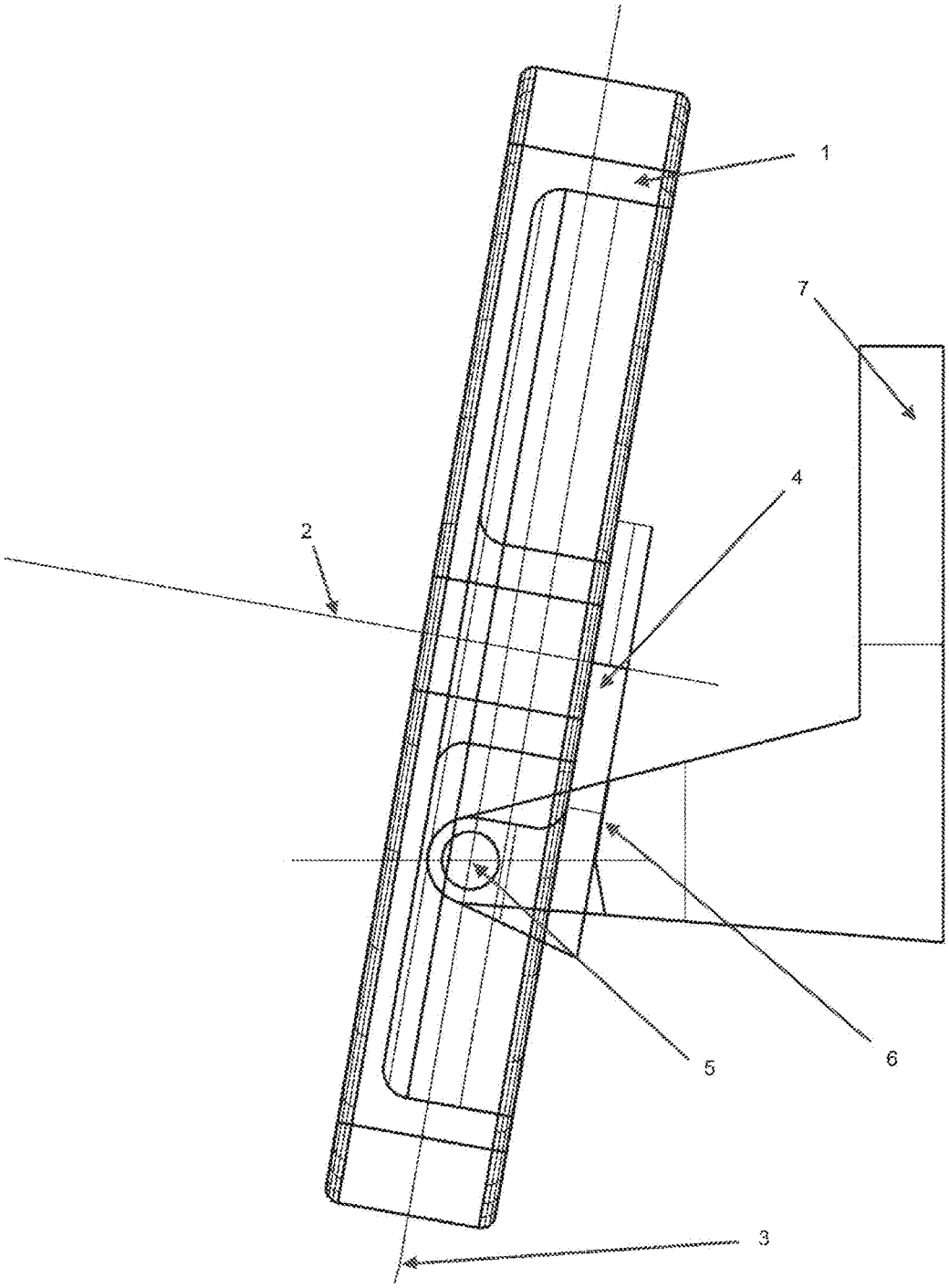
FIG. 9 is a schematic illustration of the steering wheel embodiment shown in FIG. 7.
Figure 10:
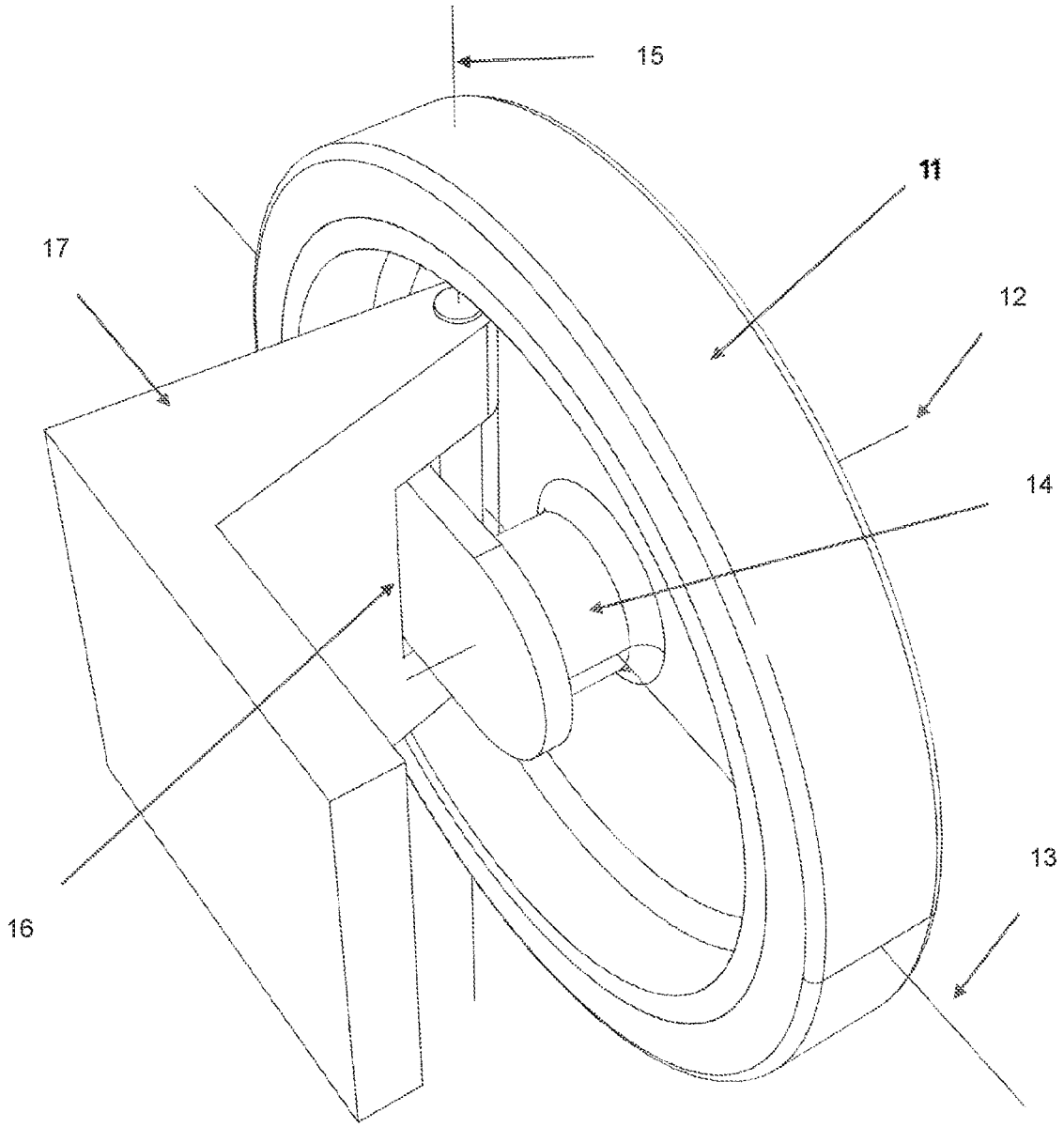
FIG. 10 is a schematic illustration of the steering wheel embodiment shown in FIG. 7.
Figure 11:
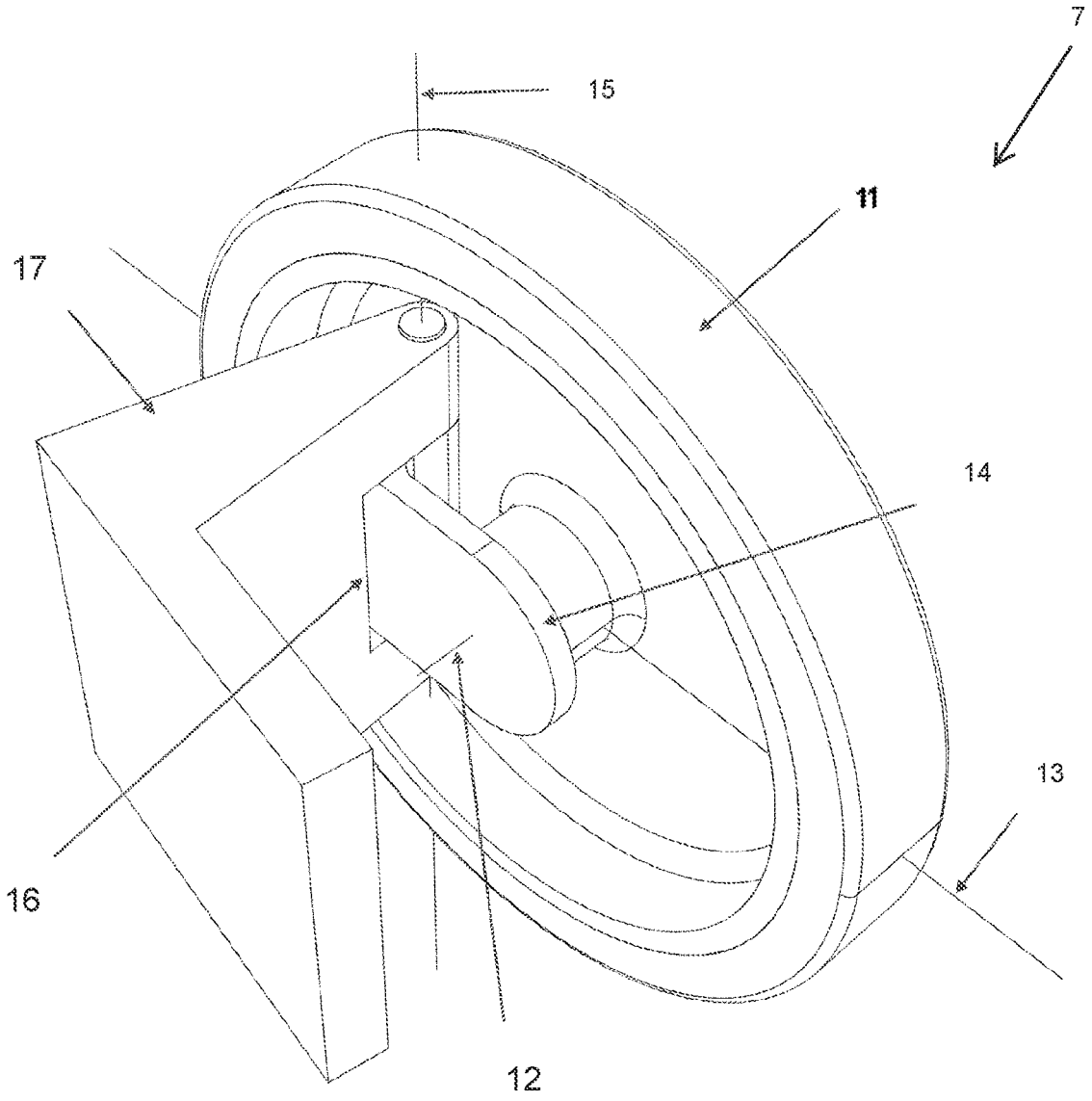
FIG. 11 is a schematic illustration of the steering wheel embodiment shown in FIG. 7.
Figure 12:
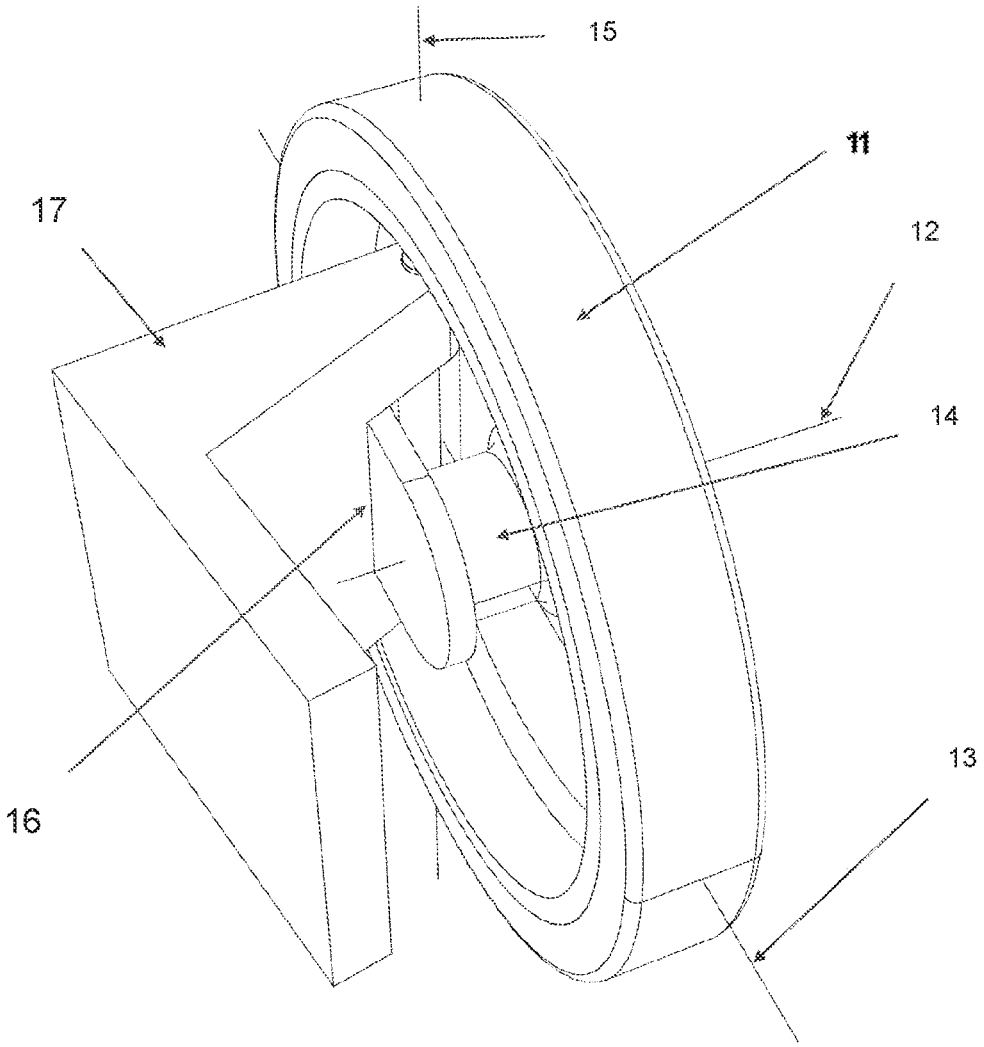
FIG. 12 is a schematic illustration of the steering wheel embodiment shown in FIG. 7.
Figure 13:
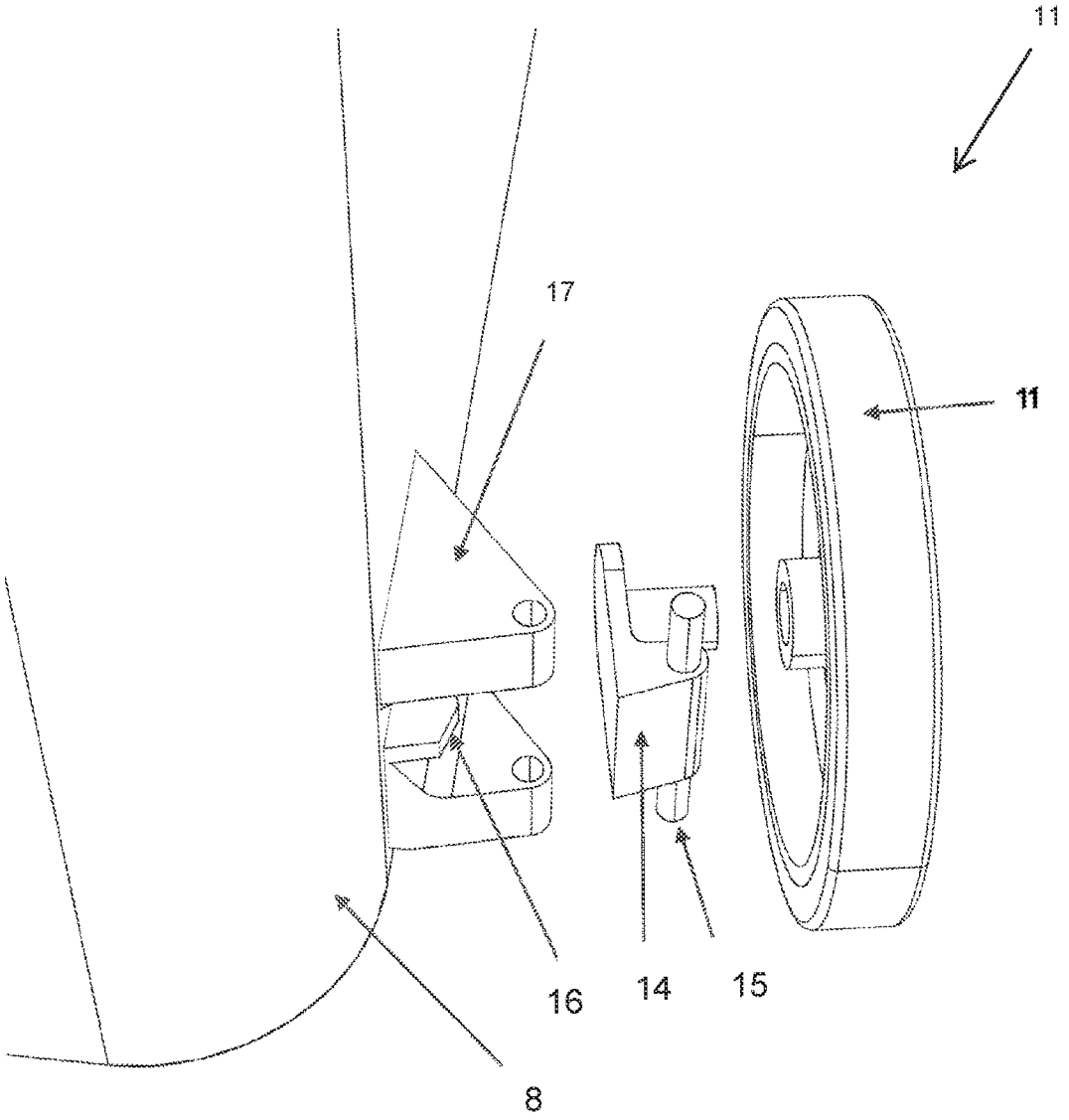
FIG. 13 is a schematic illustration of the steering wheel embodiment shown in FIG. 7.
Figure 14:
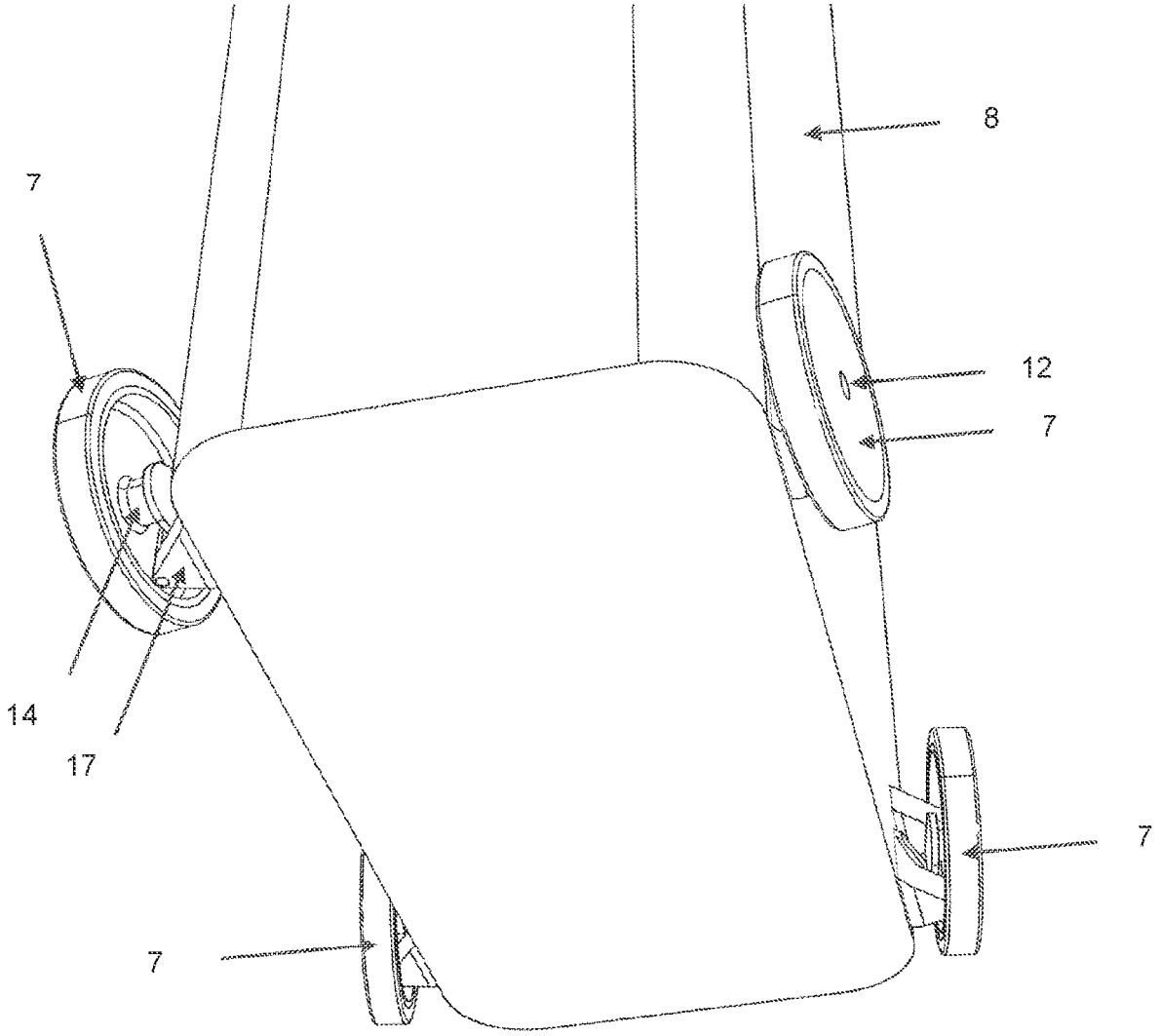
FIG. 14 is a schematic illustration of the steering wheel embodiment shown in FIG. 7.
Figure 15:
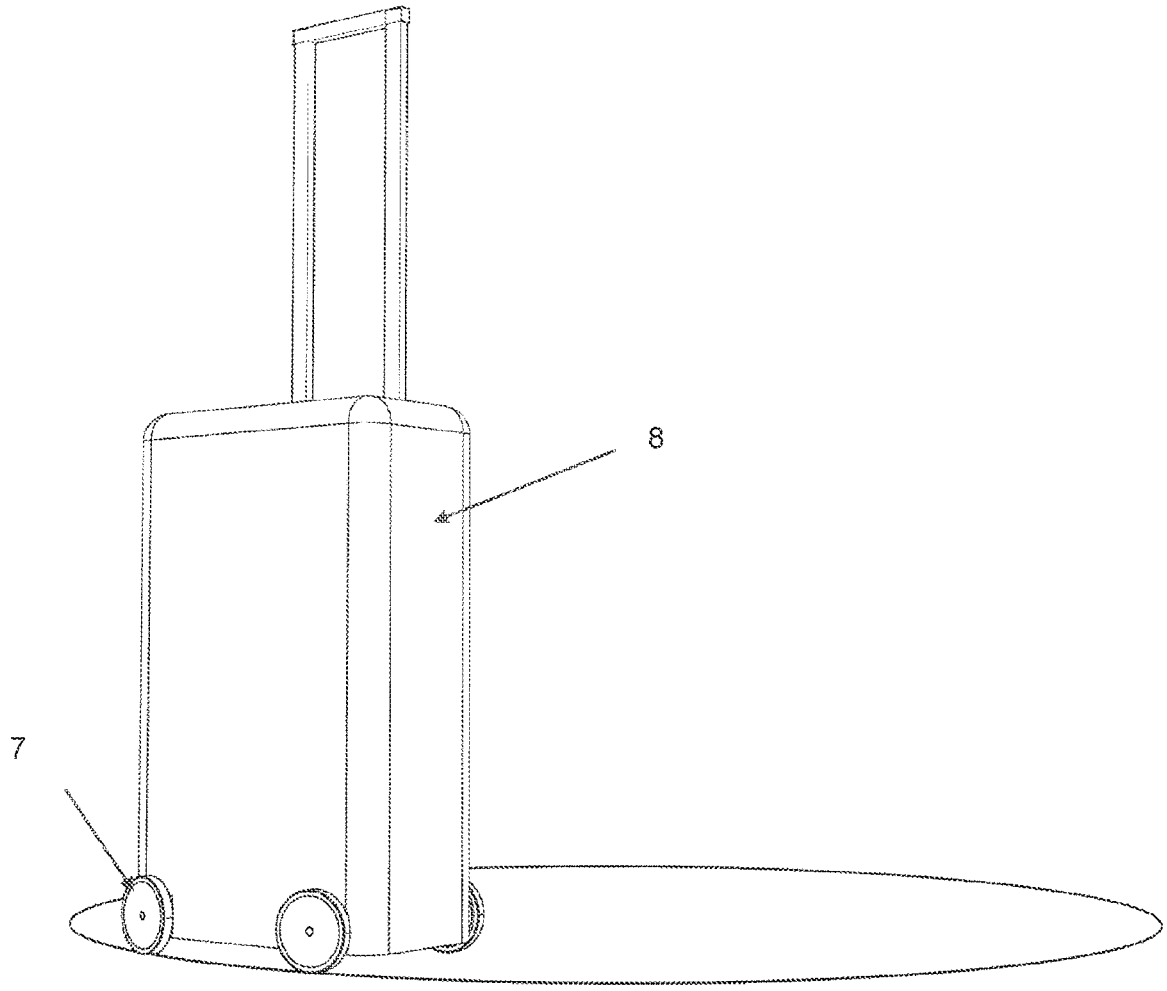
FIG. 15 is a schematic illustration of the type of steering wheel shown in FIG. 7.
Figure 16:
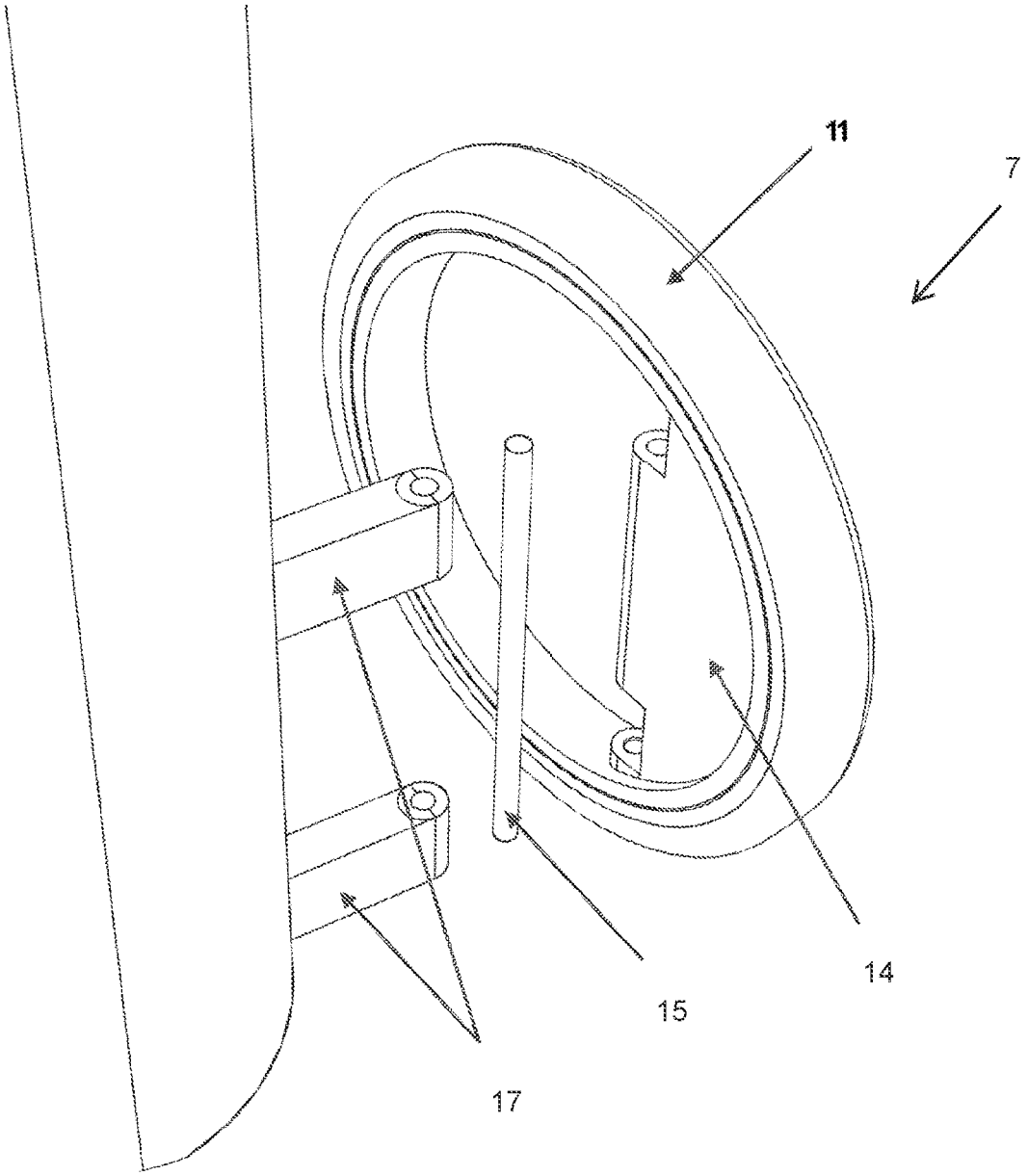
FIG. 16 is a schematic illustration of the FIG. 7 embodiment of a steering wheel.

Through an arrangement of highly elastic connections and semi-elastic or rigid shell elements or their segments, a half of a case with a volume of between 25 and 100 liters can fold in such a way that only the material thicknesses of the case shell define the height of the folded case. This reduces the volume of the entire case to a fraction of its previous volume.

The foldable travel case is cuboid-shaped and is moved upright on up to 4 wheels, via a handle or handle linkage on the top of the case. Typically, in this orientation, the two smallest sides form the top and bottom of the case, the second largest sides form the elongated handle/hinge sides, and the two largest sides form the side surfaces on which an open case rests when packed. A zipper or zipper and a hinge form the closure of both halves of the case.

Unlike a hinged folding case, the top and bottom 3, the elongated handle/hinge sides 2, and the side surface 1 of a travel case half are joined at edges by a connecting strip 4 of soft elastic, yet tear-resistant material made of leather, plastic, rubber, silicone, textile, fabric, or a combination thereof.

Four additional connecting strips 5 of soft elastic, yet tear-resistant material made of leather, plastic, rubber, silicone, textile, fabric or a combination thereof, arranged at 45 degrees to the short edges, in the corners exclusively of the 2 opposite upper and lower sides 3 of a case half, together with the opposite handle/hinge sides 2, allow the upper and lower sides 3 and the handle/hinge sides 2 to fold in almost synchronously in the direction of the side surfaces 1.

Since the connecting strips 4 and 5 have different widths cannot have a fixed pivot point and thus the top and bottom sides of the case 3, the elongated handle/hinge sides 2 and the side surface 1 can move and deflect in several directions relative to each other, the synchronous folding of the two top and bottom sides 3 and the two elongated handle/hinge sides 2 onto the side surface 1 is simplified.

Both halves of the case can now fold individually from each other once the zipper is open on at least 3 sides. One side, preferably the hinge side of the case can remain as a connection to make the case easier to operate and close. However, the connection of the two shells may be disconnected for assembly or repair.

However, the movable arrangement of the top and bottom 3 and the handle/hinge sides 2 entails that the bottom surface can no longer be used for mounting wheels 7 as usual. On the one hand, the surface is no longer stable in itself due to the elastic connections 4 and 5, and on the other hand, the bottom surfaces 3 with their visible outer surface fold towards each other in such a way that wheels 7 or even jaw feet would collide when folded together, making it impossible to fold the surfaces flat.

For this reason, the large side surfaces 1 of the case and their 3 dimensional structure take over the central static function and serve as reception for the wheels 7, as well as the carrying handles and the trolley handle which are introduced all forces for locomotion.

The invention of the lateral steering wheel on cases and travel bags (here called luggage 8 for short), solve these problems. The steering wheels are not mounted underneath the piece of luggage 8 on its surface facing the ground, but in pairs slim and space-saving laterally in the direction of travel, primarily in recesses on the two large side surfaces of a piece of luggage 8 on which a piece of luggage 8 is usually placed for opening. In this case, the wheels 7 protrude beyond the edge of these side surfaces, beyond the surface of the case facing the ground, in order to create the free space between the ground and the piece of luggage 8 necessary for movement.

Similar to an automobile with all-wheel steering, the 2 wheels, each mounted in succession on the left and right side surfaces, lie in a track. For steering purposes, the wheels swivel only within a defined swivel range of between 5 and 45 degrees over their caster, and not through 360 degrees like conventional suitcase wheels. Since the steering wheel only takes up a small area to swivel, compared to the usual 360 degree swiveling case wheel, each individual steering wheel takes up much less volume in the case and takes up less volume to a trunk.

Each individual steering wheel has a wheel with a soft tread 11, whose axis of rotation 12 is connected to an axle mount made of metal or fiber-reinforced plastic 14, which in turn can pivot about the steering axis made of metal 15 within a defined range and is mounted in a mounting made of plastic or metal. The mounting 17 connects the steering wheel to the luggage piece 8 by adhesive, rivets or screws.

The steering axis 15 of the axle mount 14 and thus of the wheel 7, is centered on the wheel width 13 and in front of the rotation axis 12 of the wheel 7 in the direction of travel, so that the wheel 7 has an overtravel of between 1 and 25 mm. The wheel 7 can now, by the application of force via the piece of luggage 8 and the mounting 7, swivel to the left and right up to a stop 16 in both directions from the central neutral position, which causes a steering impulse on the case.

Each wheel of a lane can pivot by a limited angle about your steering axis 15. Since both wheels 7 with axle receptacles 14 swivel simultaneously due to a lateral force on the case 8 or bag 8, the steering angles add up, resulting in a small turning circle despite the small swivel range of the wheel.

A spring element can be located between a mounting (17) and the axle receptacle (14), so that said spring element effects a return of the axle receptacle (14) and thus of the axle (12) into a defined position.

In order to achieve more stable straight running, the axle mount 14 together with the wheel 7 can be guided into the neutral position of the wheel via a spring element made of plastic or metal. The same return to the neutral position can be achieved when the wheel is loaded from above, even without the spring element, by tilting the steering axle 15 about the axle 12.

The invention claimed is:

1. Foldable travel case, comprising two case portions connected to each other to form the foldable travel case, wherein each case portion comprises:

a top and a bottom sides (3), a hinge side (2) and a side surface (1), wherein the top and bottom sides (3), the hinge side (2) and the side surface (1) of each case portion are connected to each other via first connecting strips (4), wherein the top and bottom sides (3) comprise second diagonal connecting strips (5), wherein at least one second diagonal strip (5) extends from each corner, where the side surface (1), the hinge side (2) and either top or bottom side (3) meet, angularly toward an edge where the two case portions connect.

2. Foldable travel case according to claim 1, wherein said first connecting strips are provided of a soft elastic material of plastic, rubber, silicone, textile, fabric or a combination thereof.

3. Foldable travel case according to claim 1, wherein said side surface (1) is a largest side surface (1) of the case portions.

4. Foldable travel case, according to claim 1, wherein the second diagonal connecting strips (5) are made from soft elastic, material of plastic, rubber, silicone, textile, fabric or a combination thereof, arranged at 45 degrees from said each corner.

5. Foldable travel case, according to claim 4, wherein the top and bottom sides (3) are opposite sides.

6. Foldable travel case, according to claim 3, wherein one or more wheels (7) are attached to and protrude from the largest side surface (1).

7. Foldable travel case (8) according to claim 1, wherein the foldable travel case is supported by at least a pair of steering wheels mounted to the side surface (1), wherein each steering wheel comprises a wheel (7) whose axis of rotation (12) is connected to the axle receptacle (14), which can pivot about a vertical steering axle (15) centered on the wheel's width (13).

8. Foldable travel case according to claim 7, wherein the steering axle (15) is located in front of the axis (12) in the direction of travel, thus resulting in overtravel of the wheel (7).

* * * * *